US008555683B1

(12) United States Patent
Rieder

(10) Patent No.: US 8,555,683 B1
(45) Date of Patent: Oct. 15, 2013

(54) BAG LOCK WITH POP-UP HOOD

(75) Inventor: Daniel J. Rieder, Mt. Calvary, WI (US)

(73) Assignee: Cardinal Bag Supplies, LLC, Fond Du Lac, WI (US)

( * ) Notice: Subject to any disclaimer, the term of this patent is extended or adjusted under 35 U.S.C. 154(b) by 0 days.

(21) Appl. No.: 13/368,211

(22) Filed: Feb. 7, 2012

Related U.S. Application Data

(60) Provisional application No. 61/441,974, filed on Feb. 11, 2011.

(51) Int. Cl.
*E05B 67/38* (2006.01)

(52) U.S. Cl.
USPC ..... 70/68; 70/21; 70/284; 70/285

(58) Field of Classification Search
USPC ..... 70/21, 63, 64, 68, 284, 285
See application file for complete search history.

(56) References Cited

U.S. PATENT DOCUMENTS

| | | | | |
|---|---|---|---|---|
| 3,580,016 | A * | 5/1971 | Kerr | 70/68 |
| 3,759,073 | A | 9/1973 | Rifkin | |
| 3,785,185 | A * | 1/1974 | Kerr | 70/68 |
| 4,019,353 | A | 4/1977 | Christopher | |
| 4,403,485 | A | 9/1983 | Scherbing | |
| 4,677,833 | A | 7/1987 | Scherbing et al. | |
| 4,744,230 | A | 5/1988 | Shum | |
| 4,951,485 | A * | 8/1990 | Wake | 70/68 |
| 5,013,162 | A | 5/1991 | Williams et al. | |
| 5,065,602 | A * | 11/1991 | Williams et al. | 70/68 |
| 5,820,267 | A | 10/1998 | Nobles | |
| 6,029,482 | A | 2/2000 | Rifkin | |
| 6,513,356 | B1 * | 2/2003 | Yang | 70/213 |
| 7,021,537 | B2 | 4/2006 | Tropp | |
| 7,036,728 | B2 | 5/2006 | Tropp | |
| 7,155,943 | B1 | 1/2007 | Lin | |
| 7,363,782 | B1 | 4/2008 | Misner et al. | |
| 7,415,853 | B2 * | 8/2008 | Yu | 70/68 |
| 7,444,844 | B1 * | 11/2008 | Lee | 70/21 |
| 8,234,891 | B2 * | 8/2012 | Dalton et al. | 70/21 |

* cited by examiner

*Primary Examiner* — Christopher Boswell
(74) *Attorney, Agent, or Firm* — Brannen Law Office, LLC

(57) ABSTRACT

The present invention relates to a combination and keyed bag lock with a pop-up hood. In one embodiment, a lock having a post and a rigid seat with a fixed rim is provided. A hood with a cylinder received within the post and an arm extending from the post is further provided. A key hole is within the cylinder. The arm of the hood houses a combination lock. A knob is rotatable relative the cylinder, and the hood pops up under actuation of the knob when the combination is accurately entered. The hood also pops up when the key is used to unlock the lock. The arm separates vertically from the seat when the hood pops up thereby allowing the body of a slide fastener to exit the lock.

17 Claims, 6 Drawing Sheets

FIG. 7A
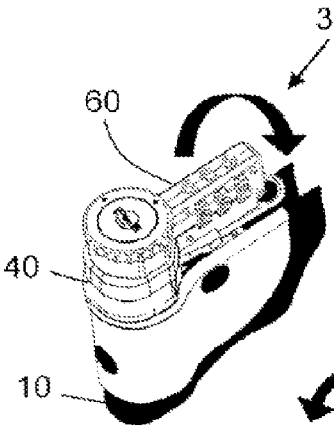
FIG. 7B
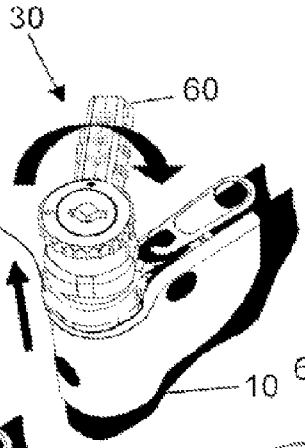
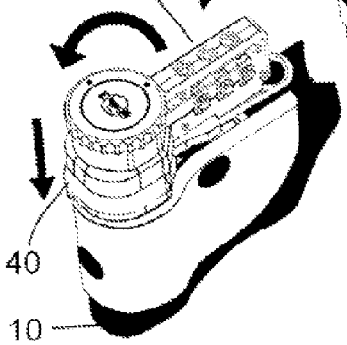
FIG. 7C
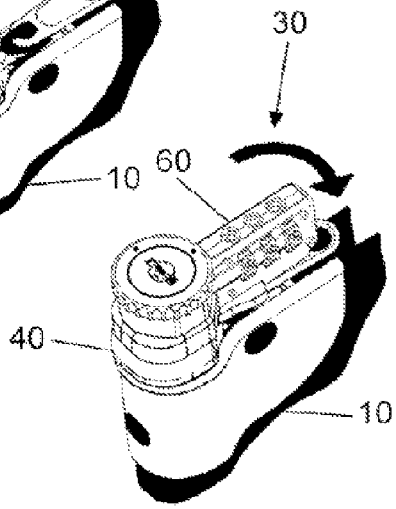
FIG. 7D

FIG. 8A
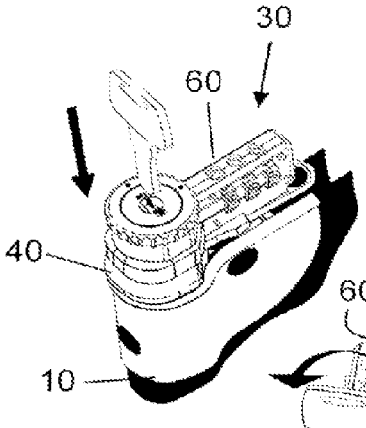
FIG. 8B
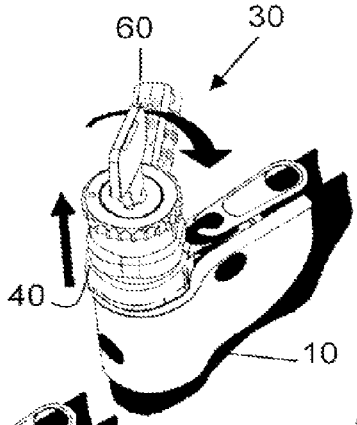
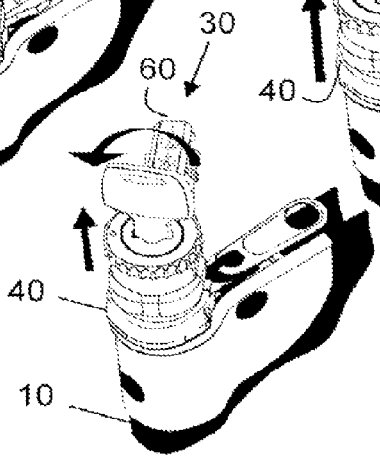
FIG. 8C
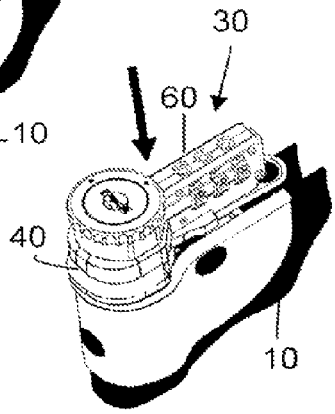
FIG. 8D

BAG LOCK WITH POP-UP HOOD

This application claims priority on and the benefit of provisional application 61/441,974 filed Feb. 11, 2011, the entire contents of which are hereby incorporated herein by reference.

BACKGROUND OF THE INVENTION

1. Field of the Invention

The present invention relates to a combination and keyed bag lock with a pop-up hood, and in particular to a bag lock having a combination housed within the hood of the lock.

2. Description of the Related Art

Locks are common in many industries. One industry in particular is banking, wherein bag locks are provided to prevent unauthorized opening of the flexible bank bags. Some examples of devices for locking bank bags, or simply bags, having slide fasteners are shown in the following patents.

U.S. Pat. No. 3,759,073 to Rifkin is titled Flexible Walled Security Container. It illustrates a flexible walled security container having an opening provided with slide fastener means along the edges of the opening and locking means carried by the container in position to releasably retain the slider of the slide fastener means in position closing the container.

U.S. Pat. No. 4,019,353 to Christopher is titled Keeper Lock for a Slide Fastener. This patent shows a key-operated keeper lock for a slide fastener that has an outer tubular barrel, an anvil projecting radially from the barrel and adapted for supporting a fastener lacing element thereon, a tubular handle rotatable in the barrel, means securing the handle against substantial axial movement relative to the barrel, a keeper arm fixed to and projecting radially from the handle for rotation therewith and adapted to overlie the anvil and a fastener lacing element thereon for retaining the lacing element between the keeper arm and the anvil to prevent operation of the fastener, a lock cylinder rotatable in the handle, tumbler means movable between the lock cylinder and the handle for alternately preventing and enabling rotation of the lock cylinder relative to the handle, a lock bolt mounted in the handle and movable when the keeper arm overlies the anvil between a position locking the handle to the barrel and an unlocking position freeing the barrel for rotation, and means coupling the lock cylinder and the lock bolt for moving the bolt between its said positions in response to rotation of the lock cylinder, said handle and said keeper arm being adapted upon movement of the lock bolt to its unlocking position to rotate between the position of the keeper arm overlying the anvil and an out-of-the-way position wherein the lacing element is accessible for manipulation, while each remains substantially in a constant axial disposition relative to the barrel.

U.S. Pat. No. 4,677,833 to Scherbing, et al. is titled Bag Lock. This patent shows a key-operated locking device using an axially fixed rotating arm, employing the anvil and rotating keeper arm concept with the anvil extending laterally from the housing. The keeper arm, with lock cylinder assembly, is firmly retained within the housing through the use of a retaining pin, and is rotatable within the lock housing to move from the lock-closed to lock-opened positions in order to confine or release the slide of a slide fastener on a zipper-type closing fabric bag, utilizing a lower detent pin having a stepped cylinder shape located axially in the tubular bore in the lock housing, which is resiliently biased against the distal end of the lock cylinder assembly, with the smaller diameter end projecting along the axis into the axial keyway just past the lowermost tumbler of the lock cylinder assembly. This pin serves to defeat attempts at unauthorized access by lock picking. On the upper surface of the lock housing is located the upper spring-loaded detent pin which, under the vertical pressure of a helical compression spring, is pushed into a cooperating notch on the lower surface of the keeper arm acting to secure the keeper arm in the lock-closed position and prelude inadvertent opening.

While each of these patents show products that may work well for their intended purposes, each design can nevertheless be improved upon.

For example, none of these patents shows a product with dual methods of opening a pop-up bag lock integrated into the design.

Further, none show a product utilizing a combination lock integrated into a bag lock.

Still further, none show a product incorporating a combination lock into the hood of the lock.

Still further yet, none show the method of opening a bank bag or slider bag using a combination lock.

Thus there exists a need for a combination and keyed bag lock with a pop-up hood that solves these and other problems.

SUMMARY OF THE INVENTION

The present invention relates to a combination and keyed bag lock with a pop-up hood. In one embodiment, a lock having a post and a rigid seat with a fixed rim is provided. A hood with a cylinder received within the post and an arm extending from the post is further provided. A key hole is within the cylinder. The arm of the hood houses a combination lock. A knob is rotatable relative the cylinder, and the hood pops up under actuation of the knob when the combination is accurately entered. The hood also pops up when the key is used to unlock the lock. The arm separates vertically from the seat when the hood pops up thereby allowing the body of a slide fastener to exit the lock.

According to one advantage of the present invention, the bag pop-up lock is openable by two processes, namely a keyed process and a combination process. A single compact lock can therefore be used and unlocked in two ways.

According to another advantage of the present invention, a combination lock is provided so that the need to carry a key is eliminated. Also, the combination lock is used in connection with a knob, whereby the knob can be concentric with the shaft reduce lock dimensions and minimize unintended twisting of the knob (and potentially unintentional lock opening).

Related, the dials of the combination lock can be accessible on the sides of the hood and the combination can be viewed from the top of the hood. The combination is therefore observable on a plane perpendicular to the bag opening (when it is opened) so that the orientation of the bag need not be manipulated after the combination is entered.

Also related, the method of opening a bank bag lock via combination lock is provided, including use of the above-noted advantageous structures.

Other advantages, benefits, and features of the present invention will become apparent to those skilled in the art upon reading the detailed description of the invention and studying the drawings.

BRIEF DESCRIPTION OF THE DRAWINGS

FIGS. 7A-7D show a series of schematic drawings showing the sequence to unlock and lock the lock by combination.

FIGS. 8A-8D show a series of schematic drawings showing the sequence to unlock and lock the lock by key.

DETAILED DESCRIPTION OF PREFERRED EMBODIMENTS

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

Figure 1:
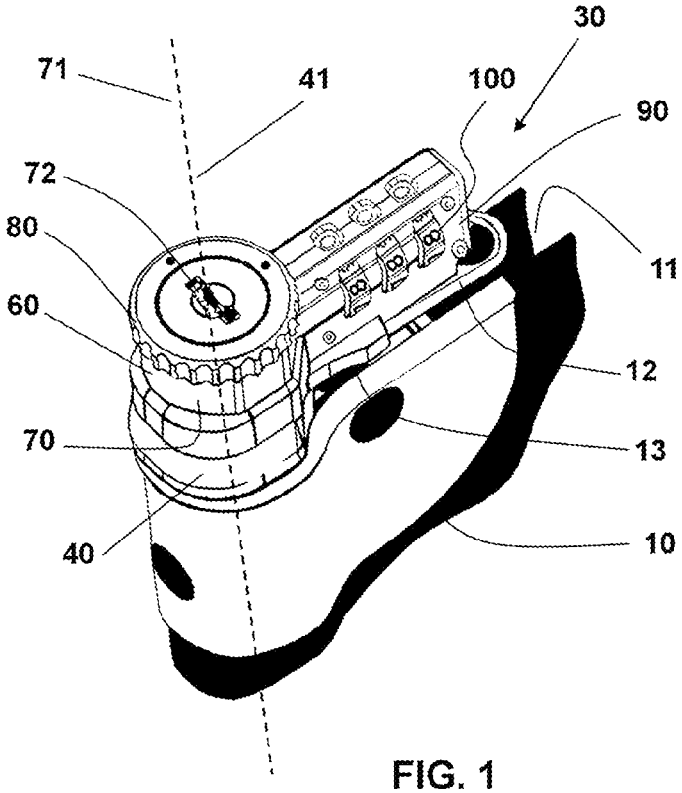
FIG. 1 is a perspective view of an embodiment of the present invention shown with a bag in a locked position.

Turning now to FIG. 1, it is seen that a bag 10 having an open end 11 with a slide fastener 12 is provided as a reference for the present invention. The slide fastener 12 has a body 21 and a tab 22. The tab 22 is used to pull the body laterally from side to side of the bag to selectably open and close the bag. The bag 10 can be a flexible sided bag used in banking and other applications. It is appreciated that the principals of the present invention are not limited to bags of this type, but rather can be used in connected with other bags or enclosures without departing from the broad aspects of the present invention.

Keeping with FIG. 1, and also looking at FIGS. 2-6, it is seen that a preferred embodiment of the present invention is illustrated. A lock 30 having a post 40 defining a vertical axis 41 is shown. Laterally extending from the post 40 is a seat 50. The seat 50 has an upper surface 51 a rim 52 extending partially around the perimeter of the seat 50, on the end of the seat remote from the post 40. The rim 52 is preferably integral with the upper surface 51 of the seat 50 and extends generally vertically therefrom.

A hood 60 is further provided. The hood 60 has a cylinder 61 that is preferably coaxial with the post 40. In this regard, pivot axis 71 of the hood cylinder 70 is co-linear with the vertical axis 41 of the post whereby the hood 60 can pivot relative the post 40 about the pivot axis 71. A key hole 72 is located on the top of the cylinder 70 to receive a key for opening the lock 30. The operation of the key is illustrated in FIG. 8.

A knob 80 surrounds the top of the cylinder 70 on top of the hood 60. The knob 80 is rotatable about an axis co-linear with the pivot axis 71. The knob 80 is positionable between a first position and a second position, as described below.

An arm 90 extends from the cylinder 70 in a direction generally perpendicular to the pivot axis 71, wherein the arm can be swept radially about the pivot axis 71 when the cylinder 70 is turned within the post 40. The arm 90 has a top 91, a bottom 92, opposed sides 93 and 94 and ends 95 and 96.

Several dials 100 are provided within the arm 90. In the preferred embodiment, there are three dials each bearing the numbers 0 through 9. However, it is understood that other numbers of dials, and dials having more or fewer numbers, or alternatively symbols or letters, may be used without departing from the broad aspects of the present invention.

The dials 100 can be accessed and turned by manipulation via the side 93 of the hood. Manipulation of the dials 100 in this regard allows the user to select the numbers that appear through combination view holes 105 on the top 91 of the hood 90. Once the combination is correctly entered and the proper numbers are displayed in the combination view holes 105, the user can twist the knob 80 from the first position to the second position to open the lock.

Operation of the combination is illustrated in FIGS. 7A-7D. It is seen how the dials are first rotated to the selected combination in FIG. 7A. The knob is then twisted about the vertical axis to unlock the lock 30 whereby the hood 60 pops up or rises from the post 40 in FIG. 7B. The hood 60 can pivot or swing relative the post 40 when unlocked. When locking the lock 30, the hood 60 is pivoted back over center of the seat and the cylinder is depressed into the post as seen in FIG. 7C. Lastly, the combination is scrambled as shown in FIG. 7D.

Operation of the keyed lock is illustrated in FIGS. 8A-8D. The motions are similar to the combination lock. However, the user uses a key instead of the combination to unlock the lock. The user first inserts the key as seen in FIG. 8A. The key is then twisted (and simultaneously twists the knob) and the cylinder of the hood 60 then pops up from the post 40 and the hood 60 is pivoted as seen in FIG. 8B. The key is twisted in the opposite direction to start the process of locking the bag as seen in FIG. 8C. Then, the key is removed and the cylinder is again inserted all the way into the post as seen in FIG. 8D.

Figure 9A:
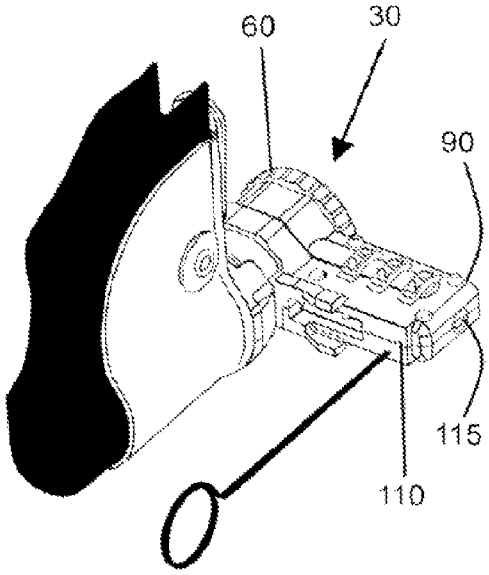
FIGS. 9A and 9B are schematic showing instructions for decoding.
Figure 9B:
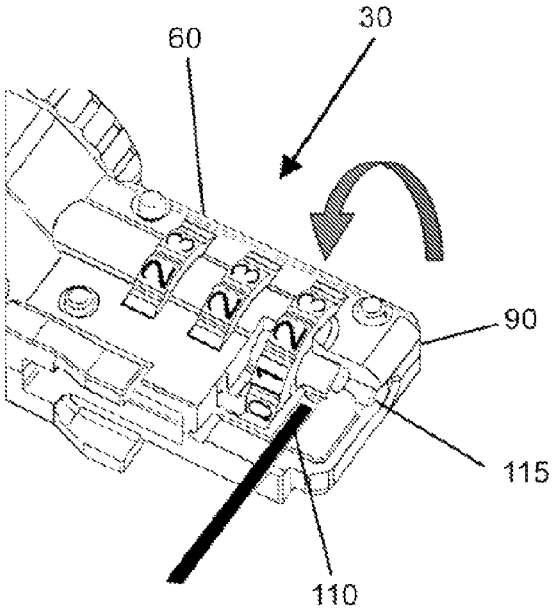

A probing hole 110 is provided to check the combination of the lock 30. The lock 30 must be opened in order to access the probing hole. The decoding of the lock is illustrated in FIGS. 9A and 9B. It is seen that a probe or structure is provided for being inserted into the probing hole 110 in order to decode the combination lock. The combinations can be individually rotated until the proper combination is obtained.

Figure 10:
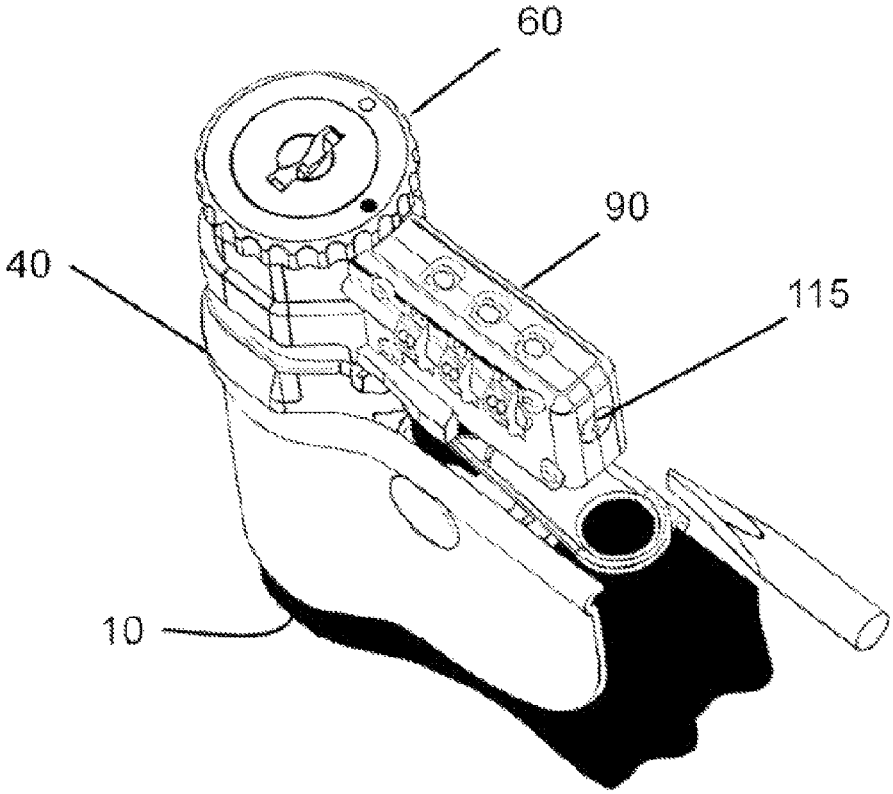
FIG. 10 is a schematic showing instructions to reset the combination.

The combination of the lock 30 can also be reset. Directions to do this are provided in FIG. 10. A flat-head screwdriver can be used to depress the reset button 115 when the lock is unlocked. Then, the combination may be set. After the combination is set, the screwdriver can be removed from the reset button.

Figure 2:
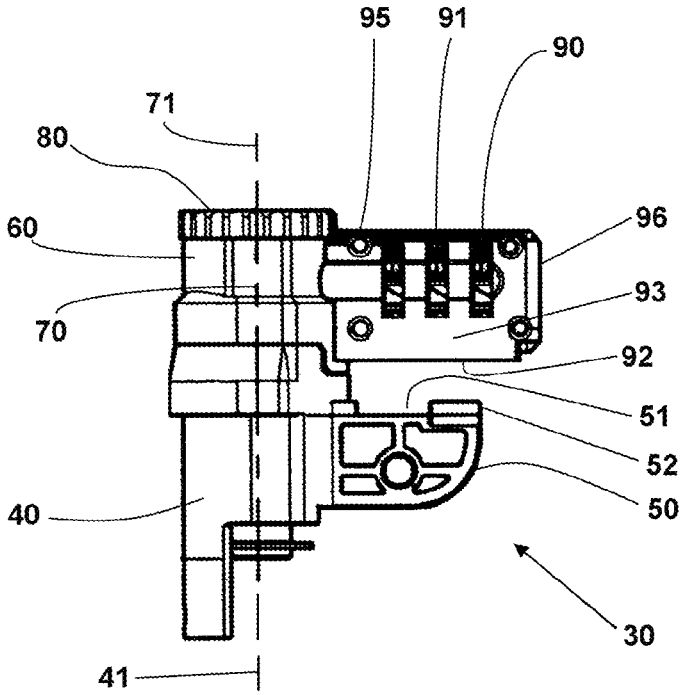
FIG. 2 is a side view of a lock of the present invention in a locked position.
Figure 3:
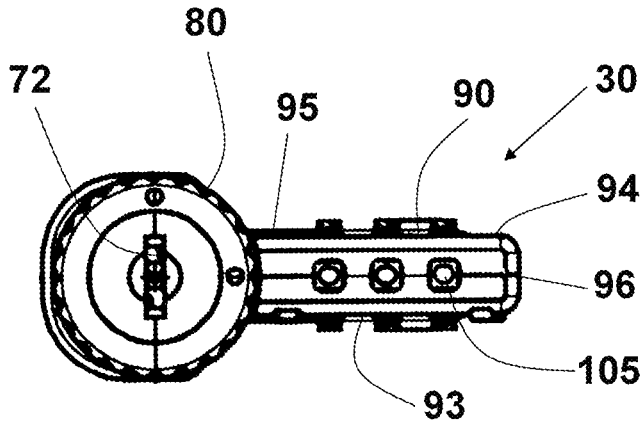
FIG. 3 is a top view of the lock shown in FIG. 2.
Figure 4:
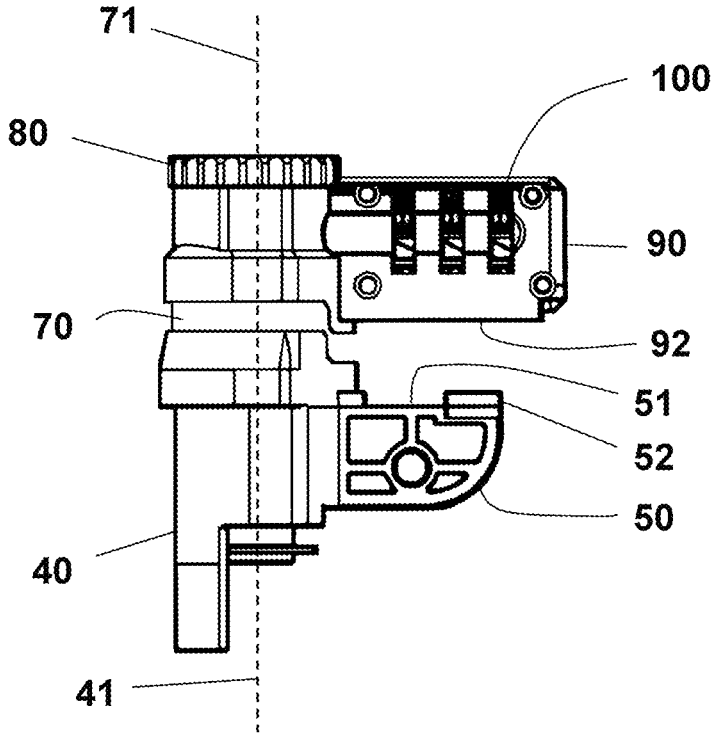
FIG. 4 is a side view of the lock shown in FIG. 2, but illustrated in an open position.
Figure 5:
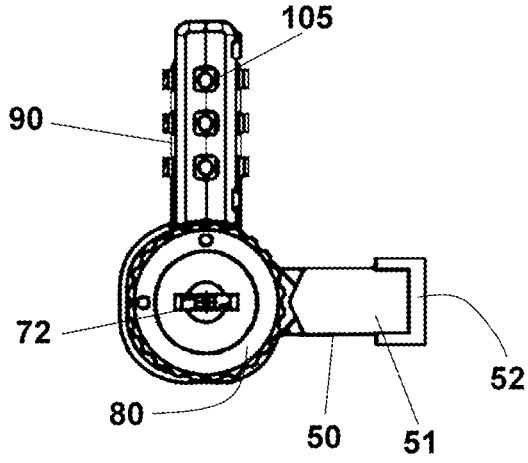
FIG. 5 is a top view of an embodiment of the present invention showing the hood rotated relative the seat.
Figure 6:
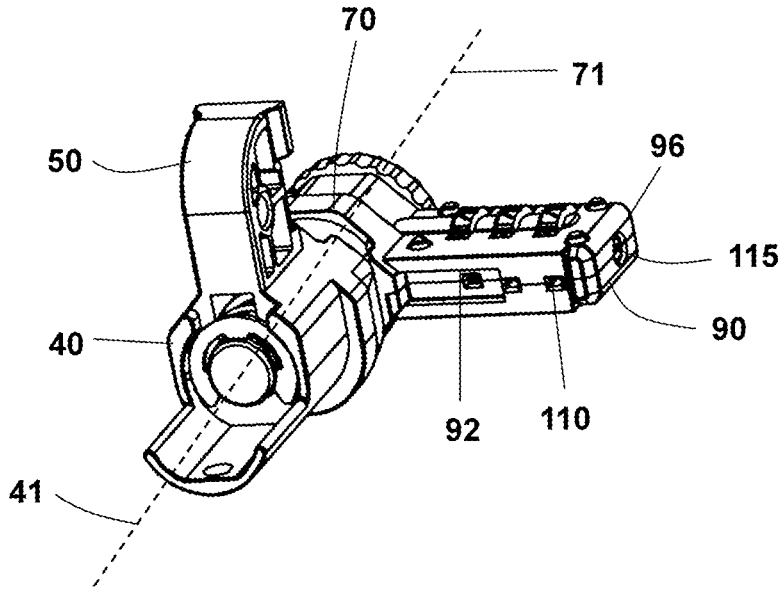
FIG. 6 is a perspective view of the embodiment illustrated in FIG. 5.

Looking again at FIG. 1, and comparing FIG. 2 and FIG. 4, it is seen how the lock 30 of the present invention can engage and secure a body 21 of a slide fastener 20. When the lock 30 is in the closed position, the body 21 of the slide assembly is securely held between the bottom 92 of the hood 90 and the upper surface 51 of the seat 50. The rim 52 of the seat 50 prevents lateral movement of the body 21 away from the end of the bag to thereby prevent opening of the bag. Once the combination is entered and the knob 80 twisted, or once the key is inserted and twisted, the hood 60 pops up or vertically extends up along vertical axis 41 so that the distance between the arm bottom 92 and seat upper surface 51 enlarges a sufficient distance to allow the body 21 to pass.

It is appreciated that some figures show an optional wing on the hood. While the wing may be useful in some embodiments, the present invention is not limited to use with a wing.

It is also appreciated that it is within the scope of the present invention to require both a key and combination to be used to unlock the lock.

Thus it is apparent that there has been provided, in accordance with the invention, a combination and keyed bag lock with a pop-up hood that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A lock for a bag having a slide fastener with a body that moves in a plane at a top of the bag, the bag further having an inside and an outside, the lock comprising:

a post fixed to the bag with a seat, said seat extending perpendicular to said post inside of the bag, said post having a vertical axis; and a hood, said hood having an arm with an arm axis that is movably positionable over said seat to lock the body of the slide fastener between said seat and said arm, said hood having a plurality of combination dials operable about said arm axis thereon, said hood further having a cylinder that is coaxial with said post, said cylinder having a pivot axis and being extendable along said pivot axis generally parallel to said vertical axis of said post to separate said arm from said seat to unlock said lock;

said lock is selectably unlockable to release the body of the slide fastener when said plurality of combination dials are rotated to a proper combination.

2. The lock of claim 1 further comprising a knob, said knob being actuatable to allow said cylinder to extend from said post and rotate about said pivot axis.

3. The lock of claim 2 wherein said knob is actuated by twisting said knob about said vertical axis of said post.

4. The lock of claim 1 wherein said plurality of combination dials are located on said arm of said hood.

5. The lock of claim 4 wherein:

said lock further comprises a three combination view holes along said arm;

said plurality of combination dials comprises three dials, each of said three dials being operable to display a selected number between the numbers 0 and 9 in the three combination view holes; and said lock is unlockable when correct numbers are viewed through the three combination view holes.

6. The lock of claim 5 further comprising a reset button, said reset button being operable when said lock is open to reset the correct number combination that will allow the lock to be unlocked.

7. The lock of claim 1 further comprising a probing hole on said arm of said hood, said probing hole being accessible only when said lock is unlocked, said probing hole allowing the user to determine the current combination that will unlock said lock.

8. The lock of claim 7 wherein said arm has a bottom, said probing hole being located along said bottom of said arm.

9. The lock of claim 1 further comprising a key hole, said key hole comprising a second way to unlock said lock.

10. The lock of claim 9 wherein:

said post has a vertical axis; and said key is insertable into said post generally along said vertical axis of said post.

11. The lock of claim 1 wherein:

said seat has an arm upper surface with a rim;

said arm has an arm bottom; and the distance between said rim and said arm bottom being smaller than the height of the slide fastener when said lock is locked.

12. A lock for a bag having a slide fastener with a body that moves in a plane at a top of the bag, the bag further having an inside and an outside, the lock comprising:

a post fixed to the bag with a seat, said seat extending perpendicular to said post inside of the bag, said post having a vertical axis;

a hood, said hood having an arm with an arm axis, said arm being movably positionable over said seat to lock the body of the slide fastener between said seat and said arm, said hood further having a cylinder that is coaxial with said post, said cylinder having a pivot axis and being extendable along said pivot axis generally parallel to said vertical axis of said post to separate said arm from said seat to unlock said lock;

a plurality of dials operable about said arm axis, said lock being selectably unlockable when said plurality of dials are rotated to a proper combination; and a key hole, said lock being selectably unlockable when a proper key is inserted into said key hole, wherein said hood is pivotable about said pivot axis when said lock is unlocked.

13. The lock of claim 12 further comprising a knob, said knob being twistable about said pivot axis when said lock is unlockable to allow said cylinder to extend from said post and rotate about said pivot axis.

14. The lock of claim 12 wherein:

said lock further comprises a three combination view holes along said arm; and said plurality of dials comprises three dials, each of said three dials being operable to display a selected number between the numbers 0 and 9 in the three combination view holes.

15. A method of operating a bag lock comprising the steps:

providing a bag having a slide fastener with a fastener body that moves in a plane at a top of the bag, the bag further having an inside and an outside;

providing a bag lock having:

a post fixed to the bag with a seat, the seat extending perpendicular to the post inside of the bag and the post having a vertical axis;

a hood, the hood having an arm with an arm axis that is movably positionable over the seat to lock the fastener body of the slide fastener between the seat and the arm; and a plurality of combination dials on the hood rotatable about the arm axis;

entering a proper combination of the plurality of combination dials on the hood; and unlocking the bag lock and by moving the hood away from the seat along the vertical axis of the post to allow the fastener body of the slide fastener to freely move.

16. The method of claim 15 wherein:

the step of providing a lock further comprises providing a lock having a knob; and the step of unlocking the lock comprises the step of twisting the knob after the proper combination is entered.

17. The method of claim 15 further comprising the steps of:

providing a key hole in the lock;

providing a key to open the lock; and using the key to unlock the lock.

* * * * *